US008655001B1

(12) United States Patent
Goldstein

(10) Patent No.: US 8,655,001 B1
(45) Date of Patent: Feb. 18, 2014

(54) IN-THE-CANAL HEARING AID USING TWO MICROPHONES

(75) Inventor: Andre L. Goldstein, Campinas (BR)

(73) Assignee: Advanced Bionics AG, Zug (CH)

( * ) Notice: Subject to any disclaimer, the term of this patent is extended or adjusted under 35 U.S.C. 154(b) by 444 days.

(21) Appl. No.: 12/701,241

(22) Filed: Feb. 5, 2010

Related U.S. Application Data

(60) Provisional application No. 61/207,528, filed on Feb. 13, 2009.

(51) Int. Cl.
*H04R 25/00* (2006.01)

(52) U.S. Cl.
USPC ..... 381/318; 381/312

(58) Field of Classification Search
USPC ..... 381/312, 313, 318, 111, 328; 600/25
See application file for complete search history.

(56) References Cited

U.S. PATENT DOCUMENTS 5,539,831 A * 7/1996 Harley ..... 381/67
6,661,901 B1 * 12/2003 Svean et al. ..... 381/328
2003/0053647 A1 * 3/2003 Kates ..... 381/318
2005/0157895 A1 * 7/2005 Lichtblau ..... 381/312
2008/0107287 A1 * 5/2008 Beard ..... 381/111
2008/0139874 A1 * 6/2008 Slattery et al. ..... 600/25
2008/0253594 A1 * 10/2008 Rasmussen et al. ..... 381/312

FOREIGN PATENT DOCUMENTS

EP 952756 A2 * 10/1999

* cited by examiner

*Primary Examiner* — Duc Nguyen
*Assistant Examiner* — Phan Le
(74) *Attorney, Agent, or Firm* — ALG Intellectual Property, LLC

(57) ABSTRACT

A method and apparatus for enhancing the performance of an in-the-canal hearing aid by temporarily increasing the adaptation speed of an adaptive feedback cancellation filter in response to sudden changes in the acoustic feedback path. The hearing aid employs a sound producing transducer (e.g., a speaker) mounted in a user's open ear canal along with a sound responsive transducer (e.g., a microphone) and a second sound responsive transducer also mounted in the ear canal and spaced a fixed distance from the first sound responsive transducer. The output signals from the first and second sound responsive transducers are applied to a digital processor which compares the respective output signals to detect impedance changes in the audio feedback path. The detected occurrence of an impedance change is then used to influence the adaptation speed of the adaptive feedback cancellation filter.

14 Claims, 3 Drawing Sheets

IN-THE-CANAL HEARING AID USING TWO MICROPHONES

This application claims the benefit of U.S. Provisional Patent Application Ser. No. 61/207,528, filed Feb. 13, 2009, which application is incorporated herein by reference.

FIELD OF THE INVENTION

This invention relates generally to hearing aid systems which use both a sound producing transducer and a sound responsive transducer mounted in a user's ear canal and more particularly to a method and apparatus for optimally canceling the effects of acoustic feedback in such systems.

BACKGROUND OF THE INVENTION

U.S. Patent Application 61/188,434 filed on Jul. 31, 2008 and incorporated herein by reference describes a hearing aid system comprised of an implanted housing having a distal portion configured to extend percutaneously to a user's ear canal to locate both a sound producing transducer (e.g., speaker) and a sound responsive transducer (e.g., microphone) in, or immediately adjacent to, the user's ear canal. In order to minimize the effects of acoustic feedback, feedback cancellation electronics is incorporated between the sound producing transducer and the sound responsive transducer.

Acoustic feedback often occurs in hearing aid devices when sound picked up by the hearing aid microphone is amplified by the hearing aid speaker, fed back into the microphone and re-amplified. This results in very annoying oscillations, or whistling, which render the hearing aid useless. Such, feedback induced oscillation is particularly difficult to avoid in open canal hearing aids having high amplification gain.

Different approaches have been proposed for reducing such feedback induced problems, including simply reducing the hearing aid gain. This however restricts the application of the hearing aid to mild hearing impairments. More sophisticated approaches can use adaptive feedback cancellation to reduce the affects of acoustic feedback. For example, U.S. Pat. No. 6,876,751 uses an adaptive digital filter to estimate the feedback signal and subtract it from the hearing aid microphone input.

A known problem with such feedback cancellation techniques is that successful operation relies on uncorrelated input signals, ideally white noise. If there is correlation between the hearing aid input and output signals, bias will likely be introduced into the adaptive filter which can compromise performance and introduce artifacts. The high correlation of tonal inputs often leads to an erroneous estimation of the feedback signal and results in the tonal inputs being subtracted. In order to minimize such problems, a time delay can be introduced into the processing loop to reduce the correlation and prevent voice signals from being degraded. However, only very short delays (milliseconds) can be tolerated before it becomes noticeable.

Another approach is to cause the filter to adapt sufficiently slowly so that important tonal inputs are not degraded by feedback cancellation processing. The disadvantage of this approach is that the adaptive filter may not adapt quickly enough to follow sudden changes which can occur in the feedback path resulting in feedback oscillations that may last until the feedback has stabilized. Accordingly, it appears that fast adaptation speeds are desirable when the filter needs to adapt to sudden changes in the feedback path but slow adaptation speeds are desirable to preserve voice and tonal signal sound quality.

Sudden changes in the acoustic feedback path are likely to occur as a consequence of normal activities such as placing a cellular phone close to the user's ear or placing a hat on the user's head while the hearing aid is operating. Such sudden changes in the acoustic feedback path are likely to produce feedback induced oscillations unless the adaptive cancellation filter adapts fast enough to follow such changes. In order to avoid these oscillations, fast adaptation speeds are required for such dynamic situations, i.e., sudden changes in the acoustic feedback path.

SUMMARY OF THE INVENTION

The present invention is directed to a method and apparatus for enhancing the performance of an in-the-canal hearing aid by temporarily increasing the adaptation speed of an adaptive cancellation filter in response to sudden changes in the acoustic feedback path.

A hearing aid in accordance with the invention employs a sound producing transducer (e.g., a speaker) mounted in a user's open ear canal along with a primary, or first, sound responsive transducer (e.g., a microphone). Under normal, or static, conditions, electronics within the hearing aid processes an output signal provided by the first sound responsive transducer to drive the sound producing transducer. The electronics includes an adaptive feedback cancellation filter which normally operates at a first relatively slow adaptation speed to provide high quality sound output.

A preferred embodiment in accordance with the invention additionally employs a secondary, or second, sound responsive transducer mounted in the user's open ear canal and spaced a fixed distance from the first sound responsive transducer. The output signals from the first and second sound responsive transducers are applied to a digital processor which compares the respective output signals to detect impedance changes in the audio feedback path. The detected occurrence of an impedance change is then used to influence the adaptation speed of the adaptive feedback cancellation filter.

DETAILED DESCRIPTION

The present invention is useful in a hearing aid system including a sound producing (SP) transducer (e.g., speaker) and a primary sound responsive (SR) transducer (e.g., microphone) mounted in (where "in" is intended to include—adjacent to—) a user's ear canal. A system in accordance with the present invention additionally incorporates a secondary SR transducer mounted in the ear canal in order to detect impedance changes in the audio feedback path, i.e., from the SP transducer to the primary SR transducer. As will be described hereinafter, the detected impedance changes are used to influence an adaptive feedback cancellation filter coupling the SP transducer to the primary SR transducer.

Figure 1:
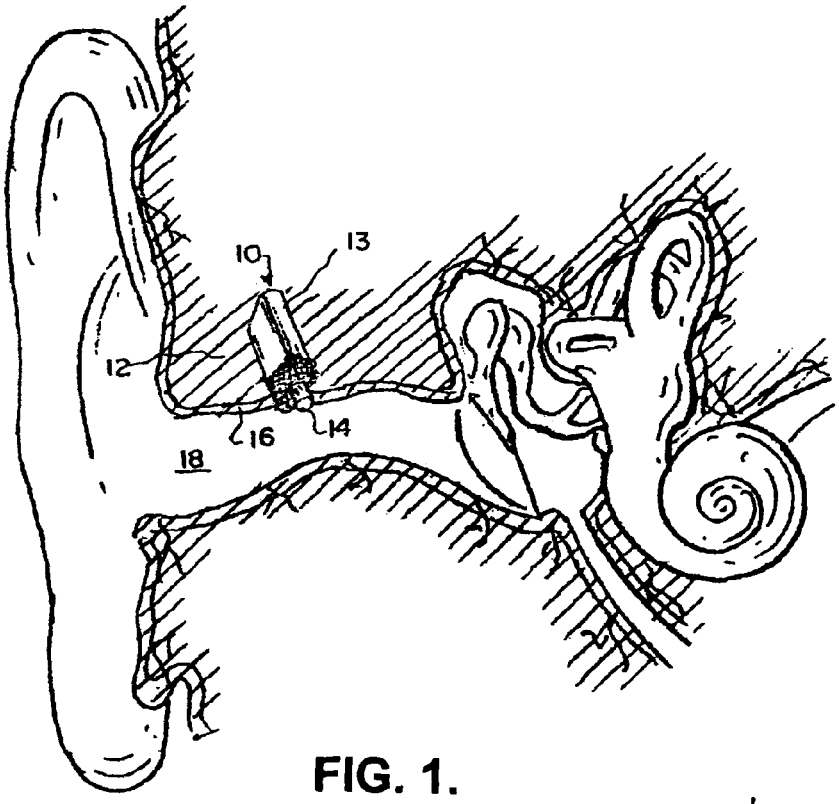
FIG. 1 is a sectional view schematically showing a subcutaneously implanted housing having a distal portion extending percutaneously into a user's ear canal.
Figure 2:
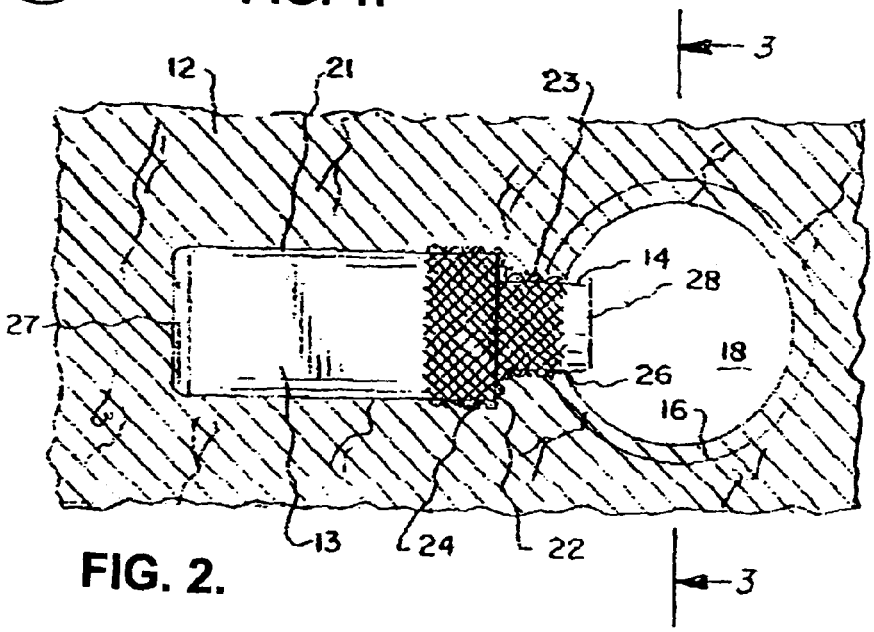
FIG. 2 is an side sectional view showing the housing distal portion extending percutaneously into the user's ear canal.
Figure 3:
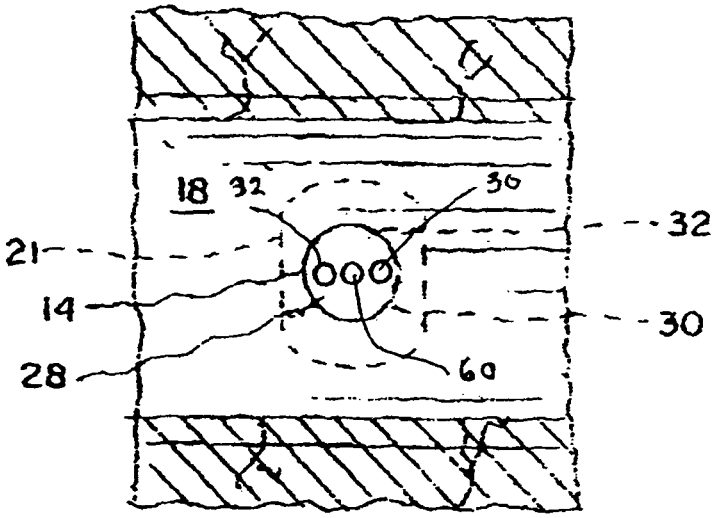
FIG. 3 is a cross sectional view taken substantially along the plane 3-3 of FIG. 2 showing a sound producing transducer and first and second sound responsive transducers located in or adjacent to the user's ear canal.

The particular manner of mounting the transducers in the user's ear canal is not critical to the present invention. FIGS. 1-3 to be described hereinafter depict one preferred mounting technique but it should be understood that various other techniques can be used to fixedly locate the transducers in the user's ear canal to implement the present invention.

Attention is now directed to FIGS. 1 and 2 which are identical to corresponding figures in the aforementioned U.S. Application 61/188,434. These figures illustrate an exemplary hearing aid housing 10 implanted in subcutaneous tissue 12 of a user's retro-auricular space. The housing 10 comprises a body portion 13 and a distal portion, or stud, 14 which projects distally from the body portion to percutaneously penetrate skin tissue 16 surrounding the patient's ear canal 18. The housing 10 includes a longitudinally extending body surface 21, a laterally oriented shoulder surface 22, and a longitudinally extending stud surface 23. A layer of porous material 24 is preferably affixed to the longitudinal body portion surface 21, the longitudinal stud surface 23, and the lateral shoulder surface 22. The porous material 24 acts to promote healthy tissue ingrowth to form a bacteria resistant barrier around the percutaneous penetration site 26 through skin tissue 16. The porous layer 24 can be formed by a mesh of intersecting fibers of a suitable biocompatible material (such as a metal, e.g., titanium, nitinol, silver, or stainless steel or a polymeric material, e.g., polyolefins, Teflon, nylon, Dacron, or silicone) to define a porosity conducive to promoting soft tissue ingrowth, e.g., with pore sizes within a range of 50 to 200 microns and having a porosity of 60 to 95%. Also, it is generally desirable to apply a coating containing one or more antimicrobial and/or anti-inflammatory agents on the housing exterior surface and/or porous layer to promote tissue healing and/or resist infection and inflammation.

A preferred housing 10 contains electronics including power supply and signal processing circuitry (FIG. 5) for driving a sound producing (SP) transducer 30 for projecting sound energy directly into the patient's ear canal 18. An exemplary housing 10 has a length between its proximal face 27 and distal face 28 of about 2.5 cm, a height of about 0.7 cm and a width of about 0.5 cm.

As described in the aforementioned application 61/188,434, the sound producing ("SP") transducer 30 and a primary sound responsive ("SP") transducer 32 are mounted in the stud 14 substantially coplanar with the stud distal face 28. The transducers 30, 32 are preferably spaced in the direction of the ear canal 18 with the SR transducer 32 preferably positioned closer to the ear canal exterior opening and the SP Transducer 30 positioned more deeply in the canal.

The signal output of SR transducer 32 can be electrically coupled to the input of SP transducer 30 by well known hearing aid electronics (e.g., see U.S. Pat. No. 6,876,751, FIG. 4) such as illustrated in FIG. 5 herein. More particularly, FIG. 5 illustrates an exemplary hearing aid forward path 40 from SR transducer 32 to SP transducer 30 as including analog to digital conversion (AD) 44, hearing aid processing electronics 46, volume control (VC) 48, and digital to analog conversion (DA) 50.

Aforementioned U.S. Pat. No. 6,876,751 also teaches the use of an adaptive feedback canceller circuit 52 (FIG. 5) which is intended to cancel the effects of acoustic feedback from SP transducer 30 to SR transducer 32 to prevent annoying oscillations, or whistling. The feedback canceller circuit 52 is illustrated in FIG. 5 as including time delay circuit 54 and an adaptive digital filter (ADF) 56. The function of the canceller circuitry 52 is to model the physical acoustic feedback path to generate a feedback cancellation signal 57 at the output of ADF 56 which is then combined with the output of AD circuit 44 in summer 58 to produce the signal input to processing electronics 46. The ADF 56 comprises an adjustable filter which uses filter coefficients to generate the feedback cancellation signal 57. A coefficient adaptation controller 59 adjusts the filter coefficients to best approximate the acoustic feedback path. As noted in U.S. Pat. No. 6,876,751, various filtering methods and structures and algorithms exist which are suitable for approximating the feedback path. U.S. Pat. No. 6,876,751 teaches that the ADF should be configured in such a way that it limits the bandwidth of adaptation signals to the frequency regions known to contain oscillation frequencies. "By doing so, the adaptive feedback canceller adapts very quickly in the oscillation frequency regions with much less adaptation noise and adapts very slowly in other regions".

Figure 4:
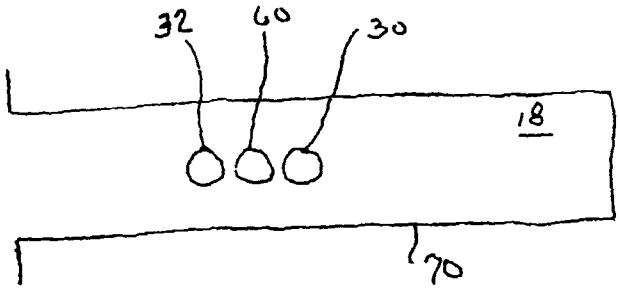
FIG. 4 schematically shows the sound producing and sound responsive transducers mounted in an acoustic transmission line representative of a user's ear canal.
Figure 5:
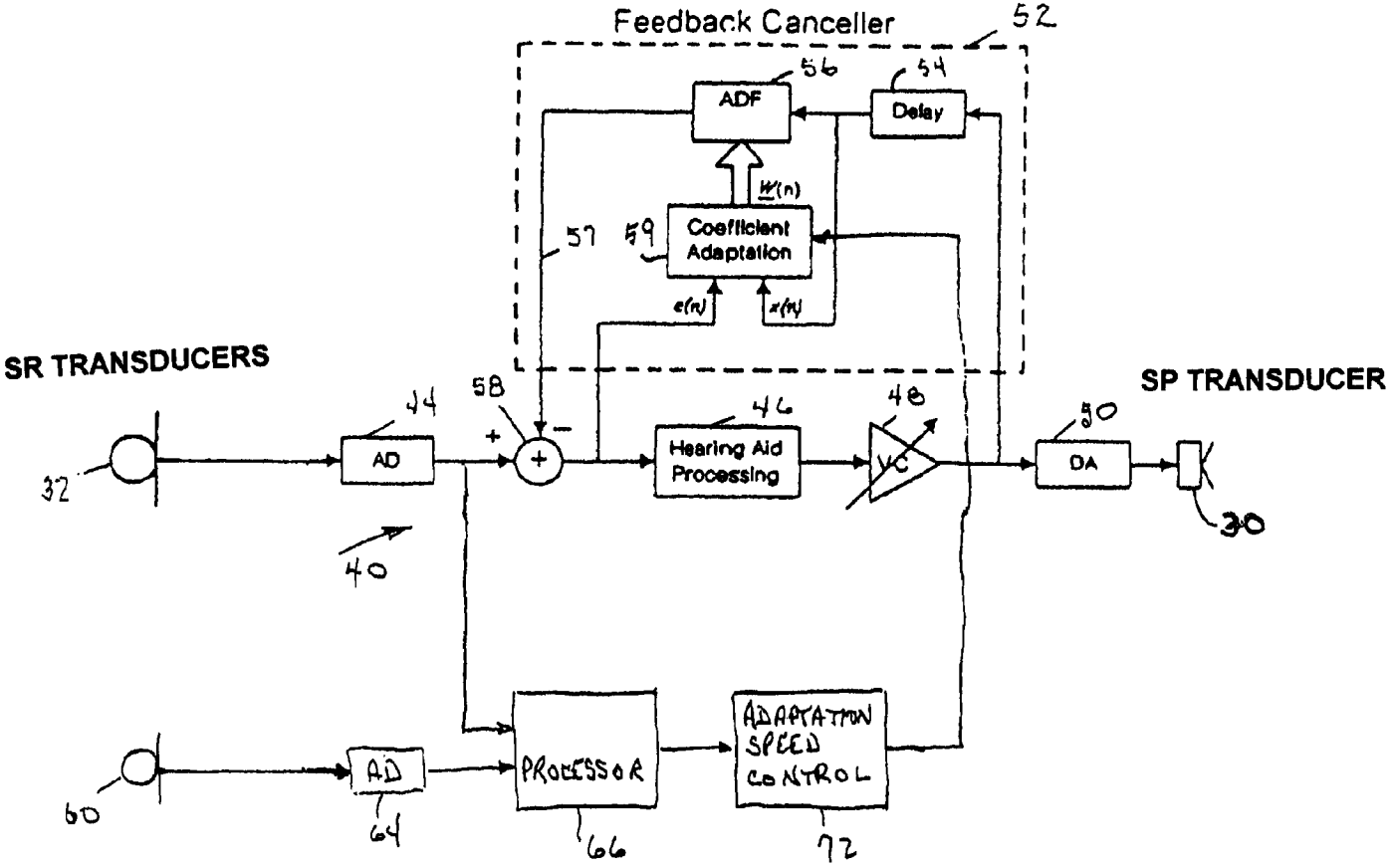
FIG. 5 is an electronic block diagram showing an exemplary system embodiment in accordance with the present invention for minimizing the effects of acoustic feedback.

In accordance with the present invention, a second SR transducer 60 is incorporated in the hearing aid system represented in FIGS. 3-5, for the purpose of detecting impedance changes in the acoustic feedback path such as might be attributable to various sudden, or dynamic, factors such as the user raising a cellular phone to his ear. This second SR transducer 60 is shown in FIG. 3 in housing stud 14 mounted in fixed relationship relative to transducers 30, 32.

The acoustic responses of SR transducers 32 and 60 operating inside the ear canal 18 are determined by their location along the ear canal and by the physical characteristics of the ear canal, including the ear canal length, the ear drum impedance and the radiation impedance of the open-end. A partial or full blockage of the ear canal entrance, as when an object is moved close to the ear, modifies the acoustic impedance of the ear canal and changes the acoustic feedback path.

In accordance with the present invention, the output signal produced by the second SR transducer 60 is processed in combination with the output signal generated by SR transducer 32 in order to detect changes in the acoustic impedance of the ear canal. More particularly, note in FIG. 5 that the output signal from SR transducer 32 derived from AD circuit 44 is applied to a first input 65 of processor block 66. Note also that the output from the second SR transducer 60 is fed through AD circuit 64 to the second input 67 of processor block 66. Processor block 66 functions to detect sudden changes in the physical acoustic feedback path by analyzing the respective signals derived from AD circuits 44 and 64 to detect a change in the acoustic feedback path impedance. The operating principle of utilizing two microphones to detect changes in the acoustic path impedance is based on the modeling of the ear canal as a one-dimensional acoustic transmission line 70 represented in FIG. 4. When the ear canal is viewed as a one-dimensional acoustic transmission line, the acoustic pressure and particle volume velocity at the location of the two SR transducers, are related to each other via a transfer matrix (equation 1). Through mathematical manipulation of this expression the ratio of the pressure at the two microphone locations can be expressed by a frequency transfer function (equation 2) that depends on 1. the distance between the microphones and 2. the acoustic impedance at one of the microphone locations.

$$\begin{bmatrix} p_1 \\ Q_1 \end{bmatrix} = [T]\begin{bmatrix} p_2 \\ Q_2 \end{bmatrix} = \begin{bmatrix} T_{11} & T_{12} \\ T_{21} & T_{22} \end{bmatrix}\begin{bmatrix} p_2 \\ Q_2 \end{bmatrix} \quad \text{Equation 1}$$

Where the individual elements of the matrix T are given by:

$$[T] = \begin{bmatrix} \cos kL & j(\rho c/S)\sin kL \\ j(\rho c/S)\sin kL & \cos kL \end{bmatrix}$$

$$p_1 = p_2 T_{11} + Q_2 T_{12} = p_2 \cos kL + jQ_2\left(\frac{\rho c}{S}\right)\sin kL$$

Where:

ρ is the air density c is the speed of sound in the air

L is the length of the ear canal

S is the cross sectional area of the ear canal k is the acoustic wavenumber

Where Q=p/Z and Z is the acoustic impedance. Then we can rewrite the expression above as:

$$p_1 = p_2 T_{11} + Q_2 T_{12} = p_2 T_{11} + p_2 \frac{1}{Z} T_{12} = p_2\left(T_{11} + \frac{T_{12}}{Z_2}\right) \quad \text{Equation 2}$$

$$\frac{p_1}{p_2} = \left(T_{11} + \frac{T_{12}}{Z_2}\right)$$

Assuming that the positions of the microphones in the ear canal remain fixed, any changes in the transfer function represented in Equation 2 are due to a change in the acoustic feedback path impedance. When processor block 66 detects a change in impedance, it causes adaptation speed control block 72 to influence an adaptation speed coefficient, or parameter, of coefficient adaptation block 59 to increase the speed of adaptation. In one embodiment of the invention, the frequency dependent transfer function (Equation 2) can be measured and stored in memory when the hearing aid device is fitted to the user for use by processor block 66 to determine when a threshold change has occurred. For static conditions, the hearing aid ADF 56 is configured to adapt relatively slowly in order to maintain good sound quality with tonal inputs. During operation, the instantaneous value of the transfer function (equation 2) is compared periodically to the stored value. If changes in the transfer function are detected by processor 66, the adaptation speed control 72 adjusts the adaptation coefficients (59) to cause the ADF 56 to adapt faster to the new feedback path condition to avoid feedback induced oscillations.

In addition, according to the current invention, other actions can be taken to prevent feedback induced oscillations when changes in the feedback path are detected using the two-microphone technique explained above including: 1. momentarily reducing the hearing aid gain until the feedback path is stabilized and (2.) switching the ADF coefficients to a different stored set of coefficients that corresponds to the new feedback path condition detected.

From the foregoing, it should now be understood that a method and apparatus have been described for reducing acoustic feedback induced oscillations in a hearing aid by changing adaptation speed as a function of changes in the acoustic path detected by comparing output signals provided by first and second spaced sound responsive transducers.

Although only a limited number of embodiments have been described herein, it should be understood that modifications and variations will occur to those skilled in the art which embody the essential characteristics of the invention and are intended to be within the scope of the appended claims.

The invention claimed is:

1. A hearing aid comprising:

a sound producing transducer configured for mounting in a user's ear canal;

a first sound responsive transducer configured for mounting in said user's ear canal, said first sound responsive transducer being further configured to detect sound and produce a first output signal based on said detected sound;

hearing aid electronics responsive to said output signal provided by said first sound responsive transducer for driving said sound producing transducer;

feedback cancellation circuitry including an adaptive digital filter that uses multiple filter coefficients to produce for producing a feedback signal;

a second sound responsive transducer configured for mounting in said user's ear canal, said second sound responsive transducer being further configured to detect said sound and produce a second output signal based on said detected sound;

an acoustic feedback path processor responsive to respective output signals provided by said first and second sound responsive transducers and configured to use said first and second output signals to detect a change in an impedance of an acoustic feedback path coupling said sound producing transducer to said sound responsive transducers; and an adaptation controller configured to control an adaptation speed of said adaptive digital filter based on said detected change in said impedance of said acoustic feedback path by modifying at least one of said filter coefficients in response to said detected change in said impedance of said acoustic feedback path.

2. The hearing aid of claim 1 wherein said first sound responsive transducer responds to incident acoustic energy to produce said first output signal; and said hearing aid further comprises an analog to digital converter means responsive to said first output signal for applying a digital signal to said hearing aid electronics.

3. The hearing aid of claim 1 wherein said sound producing transducer is mounted more deeply in said ear canal than said first sound responsive transducer.

4. The hearing aid of claim 1 wherein said hearing aid is configured to locate said first sound responsive transducer near to the external opening of said ear canal and said sound producing transducer more deeply in said ear canal.

5. The hearing aid of claim 4 wherein said second sound responsive transducer is located between said first sound responsive transducer and said sound producing transducer.

6. The hearing aid of claim 1 further including a housing adapted for subcutaneous implantation heaving a distal portion configured to extend to a user's ear canal; and wherein said first and second sound responsive transducers are mounted on said housing distal portion.

7. The hearing aid of claim 6 further including a layer of porous material mounted on said housing for promoting soft tissue ingrowth.

8. A method of operating a hearing aid having a sound producing transducer, a first sound responsive transducer mounted in a user's ear canal, and a second sound responsive transducer mounted in said user's ear canal, said method including:

detecting, by said first sound responsive transducer, a sound;

producing, by said first sound responsive transducer, a first output signal based on said detected sound;

detecting, by said second sound responsive transducer, said sound;

producing, by said second sound responsive transducer, a second output signal based on said detected sound;

adaptively responding to an electric signal driving said sound producing transducer in accordance with multiple filter coefficients to produce a feedback signal configured to cancel an effect of acoustic energy transferred along an acoustic feedback path coupling said sound producing transducer to said sound responsive transducers;

using said first and second output signals respectively provided by said first and second sound responsive transducers to detect a change in an impedance of said acoustic feedback path; and controlling an adaption speed of said adaptive responding based on said detected change in said impedance of said acoustic feedback path by modifying at least one of said filter coefficients in response to said detected change in said impedance of said acoustic feedback path.

9. A hearing aid system comprising:

a sound producing transducer;

a first sound responsive transducer configured for mounting in a user's ear canal, said first sound responsive transducer being further configured to detect sound and produce a first output signal based on said detected sound;

hearing aid electronics responsive to said output signal provided by said first sound responsive transducer for driving said sound producing transducer;

feedback cancellation circuitry including an adaptive digital filter that uses multiple filter coefficients to produce a feedback signal;

a second sound responsive transducer, said second sound responsive transducer being further configured to detect said sound and produce a second output signal based on said detected sound;

an acoustic feedback path processor responsive to respective output signals provided by said first and second sound responsive transducers and configured to use said first and second output signals to detect a change in an impedance of an acoustic feedback path coupling at least one of said first and second sound responsive transducers to said sound producing transducer; and an adaptation controller configured to control an adaptation speed of said adaptive digital filter based on said detected change in said impedance of said acoustic feedback path by modifying at least one of said filter coefficients in response to said detected change in said impedance of said acoustic feedback path.

10. The hearing aid system of claim 9 wherein said first sound responsive transducer responds to incident acoustic energy to produce said output signal; and said hearing aid system further comprises an analog to digital converter means responsive to said first output signal for applying a digital signal to said hearing aid electronics.

11. The hearing aid system of claim 9 wherein said hearing aid system is configured to locate said first sound responsive transducer near an external opening of said ear canal and said sound producing transducer within said ear canal.

12. The hearing aid system of claim 11 wherein said second sound responsive transducer is located between said first sound responsive transducer and said sound producing transducer.

13. The hearing aid system of claim 9 further including a housing adapted for mounting on or near a user's ear, said housing further having a distal portion configured to extend to the user's ear canal; and wherein at least one of said first or second sound responsive transducers are mounted on said housing distal portion.

14. A method of operating a hearing aid system having a sound producing transducer, a first sound responsive transducer mounted in a user's ear canal, and a second sound responsive transducer mounted in said user's ear canal, said method including:

detecting, by said first sound responsive transducer, a sound;

producing, by said first sound responsive transducer, a first output signal based on said detected sound;

detecting, by said second sound responsive transducer, said sound;

producing, by said second sound responsive transducer, a second output signal based on said detected sound;

adaptively responding to an electric signal driving said first sound producing transducer in accordance with multiple filter coefficients to produce a feedback signal configured to cancel an effect of acoustic energy transferred along an acoustic feedback path coupling at least one of said first and second sound responsive transducers to said sound producing transducer;

using said first and second output signals respectively provided by said first and second sound responsive transducers to detect a change in an impedance of said acoustic feedback path; and controlling an adaption speed of said adaptive responding based on said detected change in said impedance of said acoustic feedback path by modifying at least one of said filter coefficients in response to said detected change in said impedance of said acoustic feedback path.

* * * * *